US005683031A

United States Patent [19]

Sanger

[11] Patent Number: 5,683,031

[45] Date of Patent: Nov. 4, 1997

[54] LIQUID HEAT GENERATOR

[76] Inventor: Jeremy J. Sanger, 3994 Fieldview, West Bloomfield, Mich. 48324

[21] Appl. No.: 585,207

[22] Filed: Jan. 11, 1996

[51] Int. Cl.[6] ..... F24C 9/00

[52] U.S. Cl. ..... 237/1 R; 126/247

[58] Field of Search ..... 237/1 R, 8 C; 126/247; 122/26

[56] References Cited

U.S. PATENT DOCUMENTS

| | | | |
|---|---|---|---|
| 2,661,906 | 12/1953 | Stahlberg | 237/8 C |
| 3,720,372 | 3/1973 | Jacobs | 237/12.3 B |
| 4,277,020 | 7/1981 | Grenier | 122/26 |
| 5,188,090 | 2/1993 | Griggs | 122/26 |

FOREIGN PATENT DOCUMENTS

| | | | |
|---|---|---|---|
| 2500135 | 8/1982 | France | 122/26 |
| 140040 | 10/1979 | Japan | 122/26 |
| 297158 | 9/1928 | United Kingdom | 122/26 |

*Primary Examiner*—William E. Tapolcai
*Attorney, Agent, or Firm*—Charles W. Chandler

[57] ABSTRACT

A heat generator for heating a fluid, such as water, in which the fluid is delivered to a turbine chamber having an annular array of fixed buckets, and an annular of rotatable buckets mounted on a drive shaft. The rotatable cups are mounted closely adjacent the fixed cups. Fluid is delivered to the turbine chamber between the opposed buckets to heat the fluid as it moves back and forth between the confronting buckets. The heated fluid then is delivered to a heating zone such as the passenger compartment of a vehicle, and then recycled to the generator.

7 Claims, 4 Drawing Sheets

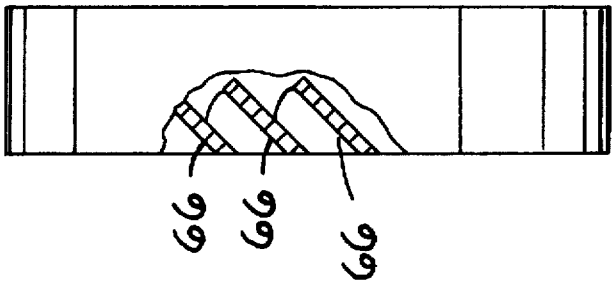
FIG. 7
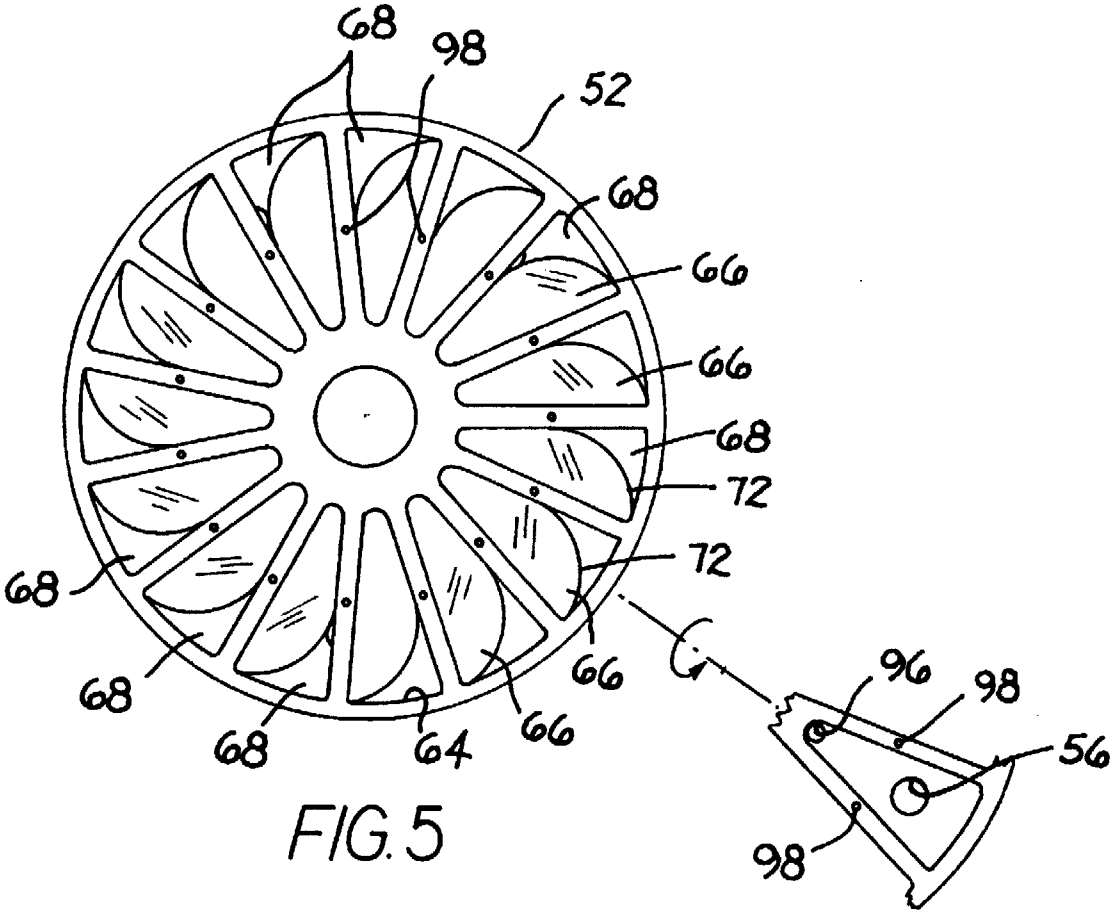
FIG. 5
FIG. 6

LIQUID HEAT GENERATOR

BACKGROUND OF THE INVENTION

Many heating systems, such as in a conventional passenger vehicle, warm an engine coolant by passing the coolant through the jacket of an engine head and block assembly. Such heating systems require a relatively long period of time to reach a temperature useful for warming the passenger compartment. The warm-up time increases as the ambient temperature decreases. Therefore, in winter, when rapid heating of the passenger compartment is most desirable, the engine warm-up period is extended.

Additionally, assuming that the vehicle is propelled by an internal combustion engine or a fuel-burning, prime-mover, hazardous emissions and pollutants from the vehicle tail pipe are more severe during the warm-up period for the engine. Some attempts have been made for providing a rapid heating system using a turbine type pump. Heat is produced by the impact of turbine buckets upon the coolant. For example, U.S. Pat. No. 3,720,372 was issued to James W. Jacobs on Mar. 13, 1973 for "Means for Rapidly Heating Interior of a Motor Vehicle". This system employs an impeller having an annular series of buckets facing a stator having an annular channel with no buckets. Such an arrangement is not believed to heat the coolant in the desired short time period.

SUMMARY OF THE INVENTION

The broad purpose of the present invention is to provide an improved heat generator for a vehicle or other environments requiring a rapid heating process. The preferred embodiment of the invention employs a housing with a turbine chamber having a stator with an annular array of buckets. A shaft is mounted in the housing and carries a rotor having an annular array of buckets that face and rotate past the stator buckets. Water is delivered to a position between the buckets and moves as a result of centrifugal force outwardly through the rotor buckets and then enters the stator buckets. Due to rotation of the rotor assembly, water particles are carried radially back and forth between the stator and the rotor buckets. This action causes the fluid particles to follow a trail in the form of a vortex path as shown in FIG. 8.

The preferred heat generator reduces the warm-up time for an automotive engine thereby reducing the emissions that occur during the warm-up period. The preferred heat generator also reduces the delay in heating the passenger compartment.

In an automotive application, the heat generator may be fluidly connected to the engine cooling system and the heater core in the passenger compartment. In other applications the pump for delivering fluid to the heat generator housing is connected to a heater core that passes air through the core for the purpose of heating the air, or the pump may be directly or indirectly fluidly connected to a base board or radiant type heating system commonly utilized in residential properties.

For an automotive use, the preferred heat generator may be used alone, replacing the vehicle's water pump and depending upon its own internal centrifugal type pump. In a domestic or commercial heating system, the heat generator may be driven by an electric motor or other prime mover. The energy generated by the heat generator can be controlled by restricting the flow through the assembly by means of a modulating control valve attached to either the inlet or the outlet ports.

As the restriction to flow through the heat generator is increased by limiting the outlet port size, the fluid is forced to remain in the pump turbine chamber for a longer period of time. Therefore a greater mass of fluid is acted upon during its passage through the turbine chamber. This longer period results in a greater transfer of heat to the fluid.

In a vehicular application, by thermostatically controlling the flow through the pump the user can reduce the flow to maximize the heating effect over a short period of time. As the vehicular heating system warms up and the engine approaches normal operating temperature, the control valve increases flow ultimately minimizing the heating effect of the pump. When this condition has been achieved, the pump functions purely as a means to pass fluid through the heating or cooling system of the automobile. Thus when the outlet of the heat generator is restricted by a regulating valve, a relatively large amount of horsepower is used to rotate the rotor of the heat generator and increase the temperature of the fluid. This rapidly heats the fluid for warming the passenger compartment heater core or other heating cores for other heating applications.

Still further objects and advantages of the invention, will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which:

FIG. 5 is a view of the stator as seen along lines 5—5 of FIG. 1;

FIG. 6 is a fragmentary view of a typical bucket cavity of FIG. 5;

FIG. 7 is a fragmentary side view of the stator; and

DESCRIPTION OF THE PREFERRED EMBODIMENT

Figure 1:
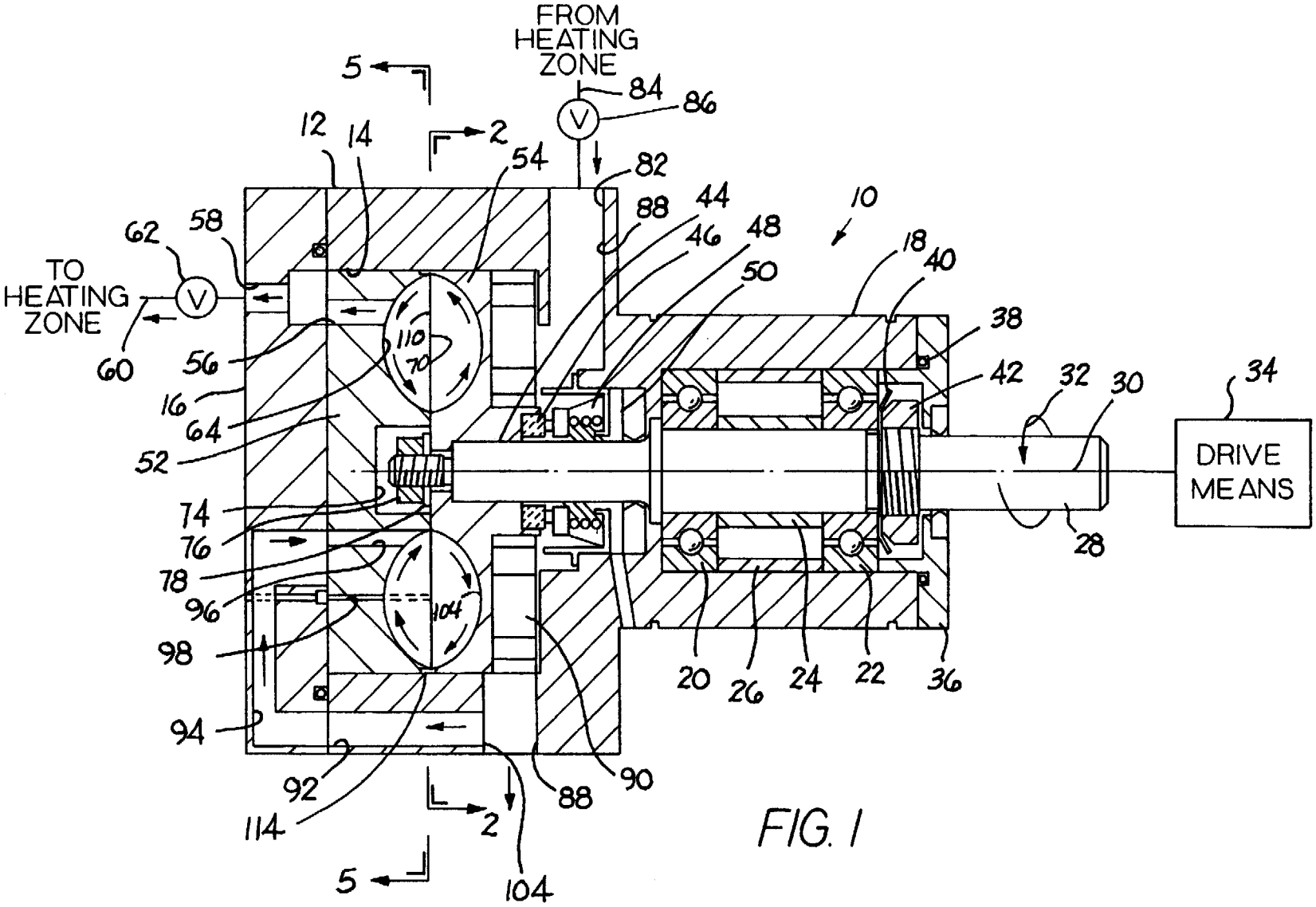
FIG. 1 is a sectional view through a heat generator illustrating the preferred embodiment of the invention with related components illustrated schematically.

Referring to the drawings, a preferred hydraulic friction heat generator 10 is illustrated in FIG. 1 and comprises a housing 12 having an internal heating or turbine chamber 14 closed off by an aluminum cover plate 16. The opposite end of the housing has a reduced end 18 supporting a pair of ball bearing means 20 and 22 separated by a pair of cylindrical spacers 24 and 26. The bearings support a drive shaft 28 for rotation about an axis 30 in the direction of arrow 32. The drive shaft is connected to a suitable drive means 34 which may a driven shaft in an automotive engine, an electric motor or the like. A bearing retainer 36 is mounted on the outer open end of the housing. An O-ring seal 38 provides a fluid-tight seal between the housing and the retainer.

A lock washer 40 and a bearing nut 42 which is threadably mounted on the shaft, hold the bearings in position. The drive shaft is narrowed at 44 and supported in the housing by ceramic ring 46. A bevel seal 48 and a lip seal 50 provide a fluid-tight seal between the turbine chamber and the bearings.

A stator 52 and a rotor 54 are mounted in the turbine chamber. The stator is fixedly mounted in the housing and has a passage 56 for discharging heated fluid through a passage 58 in the cover plate to an outlet conduit 60. A valve 62 provides means for controlling the amount of fluid passing through conduit 60. Conduit 60 delivers the fluid to a heating zone, that is, an area to be heated.

Referring to FIGS. 1 and 5, the stator has a generally semi-circular annular channel 64. Fifteen semi-circular planar vanes 66 form identically-shaped bucket cavities 68. The stator has fifteen bucket cavities 68 arranged in an annular arrangement around the axis of rotation 30 of the shaft. A passage 56 is fluidly connected to each of the 15 buckets. Each vane 66 lies at an angle of 45° with respect to the open face of the stator.

All of the stator buckets have openings disposed in a common plane 70, as illustrated in FIG. 1. Plane 70 is perpendicular to the axis of rotation of the shaft.

Referring to FIG. 1, the stator has a central recess 74 to accommodate a nut 76 which is threadably mounted on the end of the shaft together with a flat washer 78 to lock the rotor on the shaft. The rotor is clamped between the nut and an annular shoulder 80 on the narrow end of the shaft.

The housing has an inlet opening 82 for receiving a relatively cold fluid through a conduit 84 from a suitable source which may be the radiator of an automobile. A valve 86 provides means for controlling the amount of fluid entering through inlet opening 82. The fluid passes through a conduit 88 by means of a centrifugal pump 90 carried on the one side of the rotor, to pumping chamber 91. Chamber 91 is connected to a short axial passage 92 in the housing which is connected to a passage 94 in the cover plate which in turn is connected to 15 short passages 96 in the stator.

The inner end of each passage 96 is connected to one of the cup-shaped stator buckets as shown in FIGS. 1 and 6. A vent 98 connects the center of each stator bucket to the atmosphere.

Figure 4:
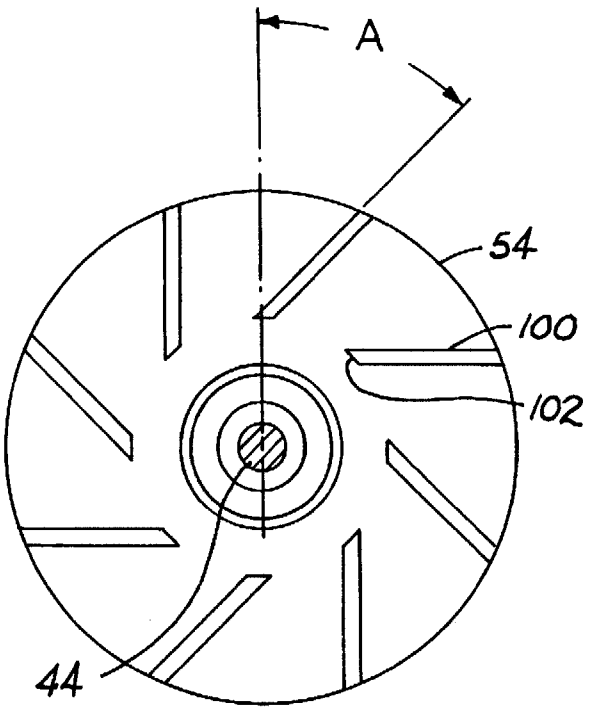
FIG. 4 is a view of the back side of the rotor to show the centrifugal pumping vanes.
Figure 3:
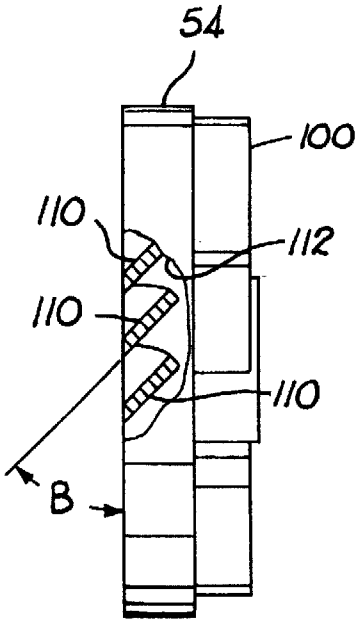
FIG. 3 is a fragmentary side view of the rotor of FIG. 2.
Figure 2:
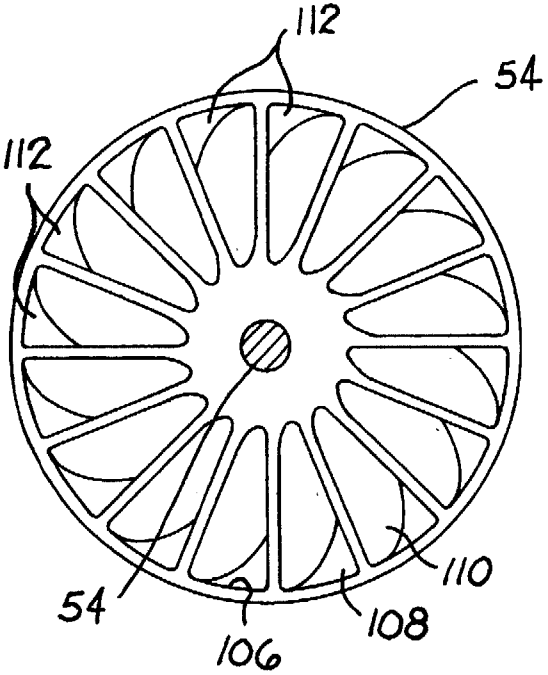
FIG. 2 is a view of the rotor as seen along lines 2—2 of FIG. 1.

Referring to FIGS. 2, 3, and 4, the centrifugal pump means comprises eight equally spaced planar vanes 100 which are flat and disposed at an angle "A", preferably 45° , as illustrated in FIG. 4. The outer edge of each vane extends closely to the periphery of the rotor, while the inner edge as at 102, is spaced from the center of the rotor for receiving the incoming fluid. The fluid travels outwardly, as the rotor is turned, to pass either toward passage 92 or through a bypass opening 104. A bypass valve (not shown) provides means for diverting some of the incoming fluid so that it does not all pass through into the turbine chamber, thereby controlling the amount of heated fluid leaving the turbine chamber. The bypass valve may be a thermostatic valve.

The left side of rotor 54 as viewed in FIG. 1, has sixteen identical bucket-shaped cavities 106. As best shown in FIGS. 2 and 3, the rotor is formed in a manner similar to the stator. It has an annular channel 108 with a generally semi-circular cross-section with 16 overlapping planar vanes 110 mounted in the channel to form 16 bucket cavities 112. Vanes 110 are disposed at an angle "B" with respect to the open face of the rotor, preferably 45° . The rotor vanes lie in planes that form an extension of the planes of the stator vanes as they are passed by the rotor vanes.

The rotor has an annular lip 114 as viewed in FIG. 1 which overlaps the edge of the stator. The rotor buckets 106 all open in a common plane 110, as illustrated in FIG. 1, which substantially coincides with plane 70 containing the openings of the stator buckets 64. The rotor buckets are substantially identical and have substantially the same distance from their innermost point to their outermost point with respect to the axis of rotation. The buckets have a substantial similarly internal curvature.

Figure 8:
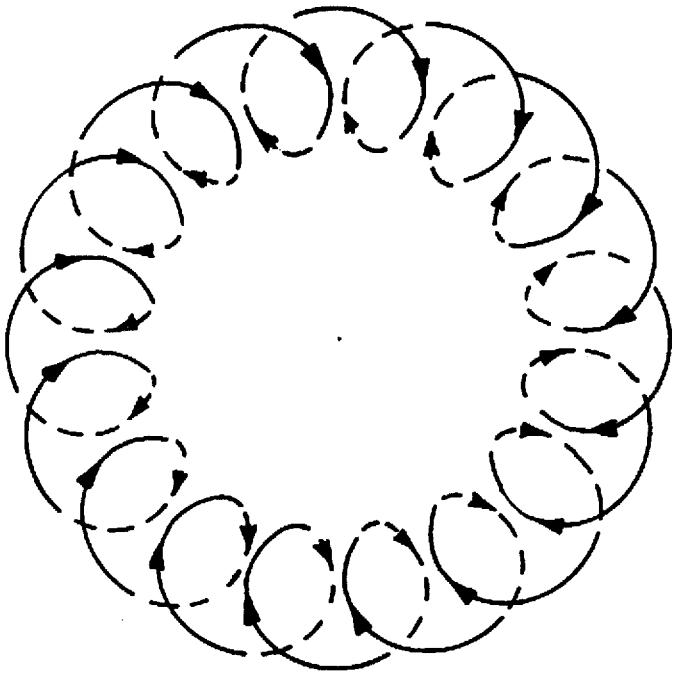
FIG. 8 illustrates the vortex path followed by the heating fluid.

Referring to FIG. 1, the incoming fluid is received through inlet opening 82 and passes through the housing to conduit 96. The incoming fluid passes into stator buckets to a position where the fluid passes back and forth between the stator buckets and the rotor buckets a generally toroidal path as shown in FIG. 8. The path is defined by the shape of the buckets, the vanes and centrifugal force, as indicated by the arrows in FIG. 1. At its outermost position, the fluid then passes from the moving rotor buckets to the fixed stator buckets toward the fifteen discharge passages 56. The heated fluid is delivered to a zone to be heated such as the passenger compartment of a vehicle, and then recycled to conduit 84.

The walls defining the buckets rotate rapidly past the corresponding walls of the rotor buckets to provide a shearing action on the fluid, as the fluid passes between the buckets. The shearing action or impact against the walls of the buckets causes the fluid to rapidly heat until it is discharged through the outlet passage 58.

A heat generator using a 4 inch diameter single-sided rotor can raise automotive coolant temperature from 32° F. to 80° F. in less than 4 minutes.

The inventor also contemplates a double-sided rotor, that is, a rotor with buckets on opposite faces rotating between a pair of stator bucket assemblies.

Having described my invention, I claim:

1. A heat generator comprising:

a housing having an internal turbine chamber, an inlet opening and first conduit means for delivering a fluid to be heated into the turbine chamber, and an outlet opening and second conduit means for receiving heated fluid from the turbine chamber;

a drive shaft means mounted in the housing for rotating about an axis;

a stator mounted in the turbine chamber, the stator having an annular array of stator buckets opening in a common axial direction;

a rotor mounted in the turbine chamber, the rotor having an annular array of rotor buckets mounted on the drive shaft means for rotation therewith,the rotor buckets facing the stator buckets and being closely adjacent thereto, and conduit means for delivering a fluid into the rotor buckets and the stator buckets;

the stator buckets having openings for passing the fluid toward the rotor buckets, said openings being disposed in a common plan that is transverse to said axis of rotation, and the rotor buckets have openings for receiving fluid from the stator buckets, said rotor bucket openings being disposed in a common plane that is closely adjacent the plane of the stator bucket openings;

drive means for rotating the drive shaft means whereby the fluid passes back and forth between the rotor buckets and the stator buckets as the rotor buckets pass the stator buckets thereby heating the moving fluid; and conduit means for passing the heated fluid to a heating zone.

2. A heat generator as defined in claim 1, including vane means mounted in the stator buckets to define the path of the fluid as it is passing through the stator buckets.

3. A heat generator as defined in claim 1, in which the number of rotor buckets varies from the number of stator buckets.

4. A heat generator as defined in claim 1, including inlet valve means for controlling the amount of fluid being delivered to the turbine chamber.

5. A heat generator as defined in claim 1, including outlet valve means for providing an obstruction to the amount of water being discharged from the turbine chamber.

6. A heat generator as defined in claim 1, including a bypass opening connected to the second conduit means for controlling the amount of fluid being delivered to the turbine chamber from the inlet opening.

7. A heat generator, comprising: :

a housing having an internal turbine chamber an inlet opening and first conduit means for delivering a fluid to be heated into the turbine chamber, and an outlet opening and second conduit means for receiving heated fluid from the turbine chamber:

a drive shaft means mounted in the housing for rotation about an axis:

a stator mounted in the turbine chamber, the stator having an annular array of stator buckets opening in a common axial direction;

a rotor mounted in the turbine chamber, the rotor having an annular array of rotor buckets mounted on the shaft means for rotation therewith, the rotor buckets facing the stator buckets and being closely adjacent thereto, and conduit means for delivering a fluid into the rotor buckets and the stator buckets;

drive means for rotating the drive shaft means whereby the fluid passes back and forth between the rotor buckets and the stator buckets, as the rotor buckets pass the stator buckets thereby heating the moving fluid;

an annular array of centrifugal pumping vanes mounted on the rotor outside the turbine chamber for pumping fluid into the housing and toward the stator buckets;

conduit means for passing the heated fluid to a heating zone; and in which the stator buckets have openings for passing the fluid toward the rotor buckets, said openings being disposed in a common plane that is transverse to said axis of rotation, and the rotor buckets have openings for receiving fluid from the stator buckets, said rotor bucket openings being disposed in a common plane that is closely adjacent the plane of the stator bucket openings.

* * * * *